United States Patent [19]

DeLucia

[11] Patent Number: 4,976,443

[45] Date of Patent: Dec. 11, 1990

[54] ARROW SYSTEM

[76] Inventor: Paul V. DeLucia, Rte. 82 R.D. 6 Box 12, Hopewell Junction, N.Y. 12533

[21] Appl. No.: 205,077

[22] Filed: Jun. 10, 1988

[51] Int. Cl.[5] ..... F42B 6/08

[52] U.S. Cl. ..... 273/421

[58] Field of Search ..... 273/416, 418–422

[56] References Cited

U.S. PATENT DOCUMENTS

| | | | |
|---|---|---|---|
| 1,455,075 | 5/1923 | Chapman | 273/416 X |
| 2,568,417 | 9/1951 | Steinbacher | 273/421 |
| 2,859,970 | 11/1958 | Doonan | 273/421 |
| 2,993,697 | 7/1961 | Urban | 273/421 |
| 3,241,836 | 3/1966 | Zwickey | 273/419 |
| 4,099,720 | 7/1978 | Zeren | 273/422 |
| 4,210,330 | 7/1980 | Kosbab | 273/422 |
| 4,341,391 | 7/1982 | Anderson | 273/422 |
| 4,579,348 | 1/1986 | Jones | 273/421 |
| 4,615,529 | 10/1986 | Vocal | 273/421 |
| 4,729,320 | 3/1988 | Whitten, III | 273/422 X |

*Primary Examiner*—Paul E. Shapiro

*Attorney, Agent, or Firm*—S. C. Yuter

[57] ABSTRACT

An archery arrow system incorporating a series of arrowheads each of which is capable of dampening the inertial shock that it transmits to the shaft it is mounted on during acceleration. The system includes a lightweight hunting arrowhead configured to force matter forward with a series of graduated stepped punching inclined surfaces embodying a punching slide pin assembly which employs rotating two-stage integral cam blades that open upon impact, adjust to a narrow cutting diameter while penetrating bone, and retract when withdrawn from game. An alternative slide pin mechanism is incorporated with the hunting arrowhead in order that it may be used as a practice arrowhead having the same shock absorbing and flight characteristics, but without the blade cutting ability. Further included in the system is a tournament target arrowhead having a superior shock absorbing slide pin mechanism which is housed in an elongated main body that may be inserted into the end of an arrow shaft.

43 Claims, 3 Drawing Sheets

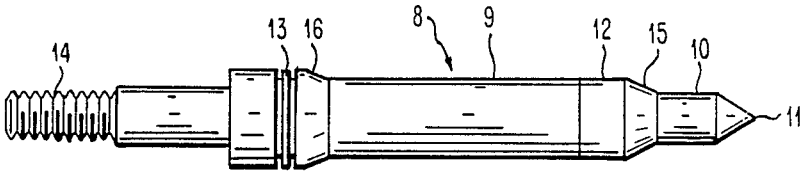
FIG. 1
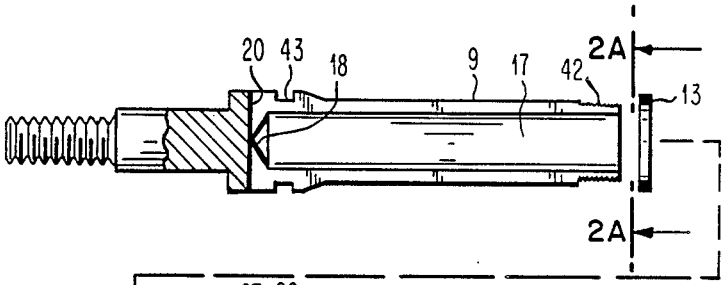
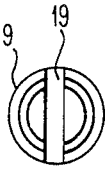
FIG. 2A
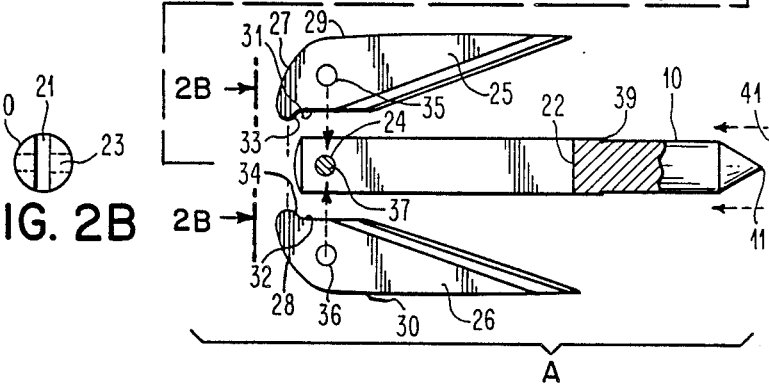
FIG. 2B
FIG. 2
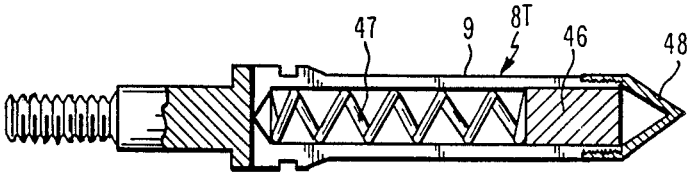
FIG. 6
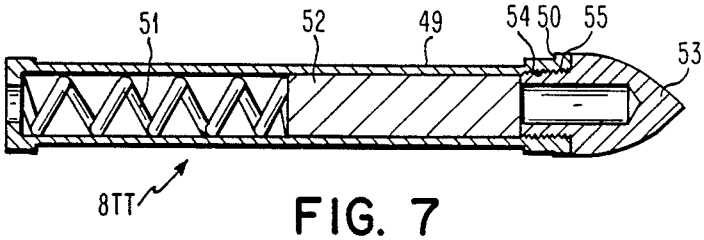
FIG. 7

ARROW SYSTEM

BACKGROUND OF THE INVENTION

1. Field of the Invention

This invention relates to archery arrow systems and more particularly to hunting and target arrows for use with various long bows, recurve bows, compound bows, crossbows, and other bows, or means for casting arrows, spears, or bolts, and other projectiles capable of carrying arrowheads.

2. Description of the Related Art

It is known that the ability of an arrow to be cast accurately is of the utmost importance. Furthermore, it is well appreciated that a hunting arrow must carry an arrowhead capable of cutting and penetrating the intended game for a quick, clean and humane kill.

In the past, bowhunters have become accustomed to compromising the speed and accuracy of hunting arrows, when compared to that which can be achieved with target arrows. Over the years, separate sets of standards have seemed to evolve for target and bowhunting equipment. Target archery equipment has been designed with the intent of enabling archers to consistently cast swift arrows at distant targets accurately. This equipment has improved to the point where many a target archer can place an arrow through an apple at fifty yards. In fact, quite a few can maintain this level of proficiency repeatedly without missing. Although bowhunting equipment has improved greatly, it has never quite been expected to perform on the level of target equipment. The development of bowhunting equipment has often been the result of compromise in an attempt to solve the more difficult problems.

Well over ninety percent of the individuals who become involved with archery, do so with the intent of hunting. They are intrigued with the challenge of the sport, and purchase equipment which they feel will serve them well. But few archers experience the proficiency that can be attained with target arrows as far as speed and accuracy are concerned. It is quite difficult for most archers to believe that they might pursue game with bowhunting projectiles that may afford them the same level of ability to shoot swiftly, accurately and consistently as in target shooting.

Almost all hunting arrowheads have utilized fixed cutting blades which project outwardly from the main body of the arrow shaft. Hence the term "broadhead" has evolved. These fixed extending blades have been necessary in the past to create an acceptable width of cut upon impact.

Minimizing the weight and aerodynamic instability of these winged arrowheads has been a critical problem. Extra weight on the forward end of any arrow is necessary to create proper balance. It serves as a guiding mass to direct the shaft that follows on a straight course toward the target. Air passing over the extended blades on a broadhead forces it to plane off course. This ill effect on flight is termed windplaning. Extra weight helps to stabilize broadheads in flight, which is one of the major reasons why they weigh more than target arrowheads for the same weight bow. Relatively heavy arrow shafts with stiffer spines are necessary to properly cast the excess weight of broadheads. Extremely large fletching must also be used to create additional drag at the rear of the arrow in order to reduce windplaning enough to maintain adequate flight characteristics.

Any arrowhead with exposed blades presents a safety hazard to the archer while handling. In many cases it is necessary to increase the length of the arrow shaft in order to avoid blade contact with the archers hand, bow handle or riser. This combination of weighty broadhead, heavy arrow shaft and large fletching has become the conventional hunting arrow.

The increased weight and drag of the conventional broadhead tipped hunting arrow causes a considerable reduction in speed. Even the slightest loss of speed will cause a bowhunter's accuracy to diminish substantially, since it is unpredictable how game will move after the shot is released. A target archer need only worry about point to point accuracy since his target is stationary. Bowhunters must also be concerned with the ability of the game to move from the path of the intended shot. Judging distance also becomes more crucial for the archer who is attempting to place the shot of a slower flying arrow, as its elevation drops off more readily with reach.

Through the years, manufactures have greatly increased the efficiency of bows to cast arrows faster. Almost all of the emphasis has gone into developing the mechanisms for casting arrow projectiles, with only minimal attention being given to the development of the projectiles themselves. Manufactures have been quite concerned about the speed of arrows coming out of the bows they produce. Arrow Velocity in feet per second, out of the bow, has become one of the dominant marketing issues.

In reality, the most important issue as far as arrow speed and bowhunting accuracy is concerned, is not how fast an arrow comes out of a bow, but how long it takes to reach the target. All of the factors which govern the speed of an arrow after it leaves the bow must be considered in order to develop a projectile that will be the swiftest to the target. It is true that faster arrows have a flatter trajectory, but trajectory is only part of the total concern for accuracy in hitting the point of aim on a target that may move. Speed to the target certainly becomes easier to appreciate when you consider that game is almost always moving to some extent. The kill area on a deer, for example, is about the size of a paper plate. If this game were to take just half a step in the time it takes the arrow to make contact, it is most probable that a wounding hit or complete miss would result, instead of the quick kill that may have harvested the game had it been stationary.

In recent years, manufactures have begun to promote bows capable of increased arrow velocity by enabling archers to shoot shorter arrows. These bows, termed "overdraws", incorporate an extension arrow rest that will support the front of an arrow drawn behind the normal drawing point. Although they will cast shorter, lighter and therefore faster arrows, their use involves some degree of compromise to the archers ease in shooting accurately. Overdraw bows are considered less forgiving to shoot, as even minimal torquing or tilting of the bow upon release can cause the arrow to be cast off course. Safety must also be considered in the use of these bows, as the head of the arrow may be drawn behind the archers bow hand.

Careful comparison of hunting and target projectiles reveals some important differences. A complete standard length hunting arrow including, shaft, nock, fletching, glue, insert and arrowhead, weighs from thirty nine to forty one percent more than a complete target arrow for the same draw length and weight of bow, depending on shooting styles. Hunting arrows, again depending on shooting styles, will take from twenty-five to twenty-nine percent longer than target arrows, to reach a target at twenty yards.

Foreshortened hunting arrows that may be used on overdraws weigh more than standard weight target arrows for the same weight full draw bow. Therefore hunting arrows still end up weighing more than target arrows even if a bowhunting archer is willing to compromise shooting ease in an attempt to reduce weight for faster flight.

Even when you compare a broadhead tipped hunting arrow to a target arrow having the same weight, the target arrow will have a considerably flatter as well as faster trajectory. This is due to the fact that the necessary extra forward weight in any arrow will cause it to travel in flight with its forward tip downward. Gravity will cause any arrow to loose altitude on the way to a given target. In the case of broadhead tipped shafts during flight, the downward orientation of the blade surfaces forces the head to plane downward, further increasing the arrow's descent. As mentioned before, the blades and necessary large fletching on a broadhead tipped hunting arrow will create excessive speed reducing drag that is not present on target arrows.

If we value our wildlife resources, and appreciate the game we pursue, it is imperative that we seek to devise and utilize equipment that will afford bowhunters the same degree of shooting proficiency as achieved by target archers.

Accordingly, there has been a continued need for a hunting arrowhead that would have at least the same ability to be cast with the speed and accuracy as a target arrowhead. Furthermore, such an arrowhead must be capable of efficiently creating a wide external cut and deeply penetrating so as to effect a quick kill, and produce a blood trail essential for tracking and properly harvesting game. This may be best accomplished by using a hunting arrowhead having the same weight and flight characteristics as a target arrowhead so that it might actually be cast on a standard target arrow shaft.

The prior art is objectionable in this regard, as it has traditionally suggested configurations that have required extra weight for sufficient penetration, and as mentioned before, for broadhead stability in flight. There is need for such a hunting arrowhead, having improved penetration performance so as to not require any additional weight beyond that which is used in standard target arrowheads on target arrows. Furthermore, past hunting arrowhead designs have been primarily configured to wedge their way, which thereby creates a restricted path having considerable friction. This inefficient use of the stored kinetic energy in a decelerating arrow, results in the overall reduction of shock, penetration, hemorrhaging, and bleed-out, that may be achieved.

The prior art is also objectionable as target and hunting arrowhead designs have had the inherent problem of transmitting shock to the shaft on which they are mounted during acceleration. The mass of these past arrowhead configurations will transmit excessive inertial shock during acceleration, causing the arrow shaft to bend, which reduces the accuracy of the arrow when cast. Higher spined, heavier and therefore slower flying arrow shafts have been necessary in order to properly cast these arrowheads.

Accordingly, there is a need for hunting and target arrowheads which are capable of reducing the shock of the inertial forces they transmit to the arrow shaft during acceleration.

Few attempts have been made to devise a slender hunting arrowhead having no diametric extensions, but rather having completely enclosed moveable blades that are intended to open upon immediate impact, prior to penetration, and thereby eliminate the problems of windplaning. Examples of such devices are suggested in U.S. Pat. Nos. 2,859,950 of Doonan and 4,579,348 of Jones. A major problem associated with these designs is the inability of their blades to efficiently, as well as effectively, open to create a wide exterior cut upon impact with the game.

In the case of the Doonan device, there is presented a blade camming mechanism which is intended to induce pivotally carried blades from a rearward completely enclosed position, to an extended open outward cutting position. In the open cutting position, the blades are not permitted to swing forward for easy removal from the game, which therefore makes it illegal for use in some states that do not permit the use of barbed arrowheads. The configuration of this mechanism in relation to its leveraging of the blades open while cutting permits all of the forces exerted against the blades to urge them to retract thereby making it difficult for them to remain open to cut a wide path. This mechanism is further lacking in camming leverage to sufficiently angle its blades open to a wide cutting diameter. It also requires the use of an exceptionally large amount of the kinetic energy stored in a decelerating arrow in order to open its blades on impact. Furthermore, it is questionable as to whether or not this mechanism will actually open its blades wide to produce a large exterior wound. This is dependant upon the degree of obstruction the head encounters when striking the game.

In respect to hunting arrowheads that employ parts intended to move rearward with reference to the arrow shaft and thereby open blades to an outward cutting position, all the parts capable of relative movement with the shaft must be recognized as separate projectiles. The head, blades and pin in the Doonan mechanism represent a substantial mass portion of the entire arrow projectile. This mass portion has its own kinetic energy stored in it during flight, and is therefore capable of considerable penetration on its own before it will slow enough for the shaft behind to force into it and press the blades outward. It is also important to note that the frictional resistance which was used to hold the blades closed during acceleration and flight must also be overcome before the blades can open. While it is probable that this mechanism will open and create an exterior cut in the hide when striking a rib for example, it is less probable it will open on impact with just the hide and softer matter between the ribs.

There is, therefore, a need for an improved hunting arrowhead which can efficiently open its blades from an enclosed position to a wide cutting position on impact, prior to penetration, so as to insure a wide exterior cut without regard to where it strikes the game, as well as not permitting all of the forces exerted against the blades while cutting to urge them to retract.

The Jones mechanism utilizes fully enclosed blades in a forward orientation relative to the arrow shaft. A problem with this mechanism is that it incorporates a plunger designed to open its blades by pressing against the sharpened edges, which results in dulling. Again, there is objection to the minimal blade opening this plunger will provide on impact, prior to penetration, as well as the inefficiency of its blades having to overcome the biasing pressure of the clutch which holds the blades closed during acceleration and flight.

The inability of prior art large blade hunting arrowheads to efficiently produce the greatest amount of cutting also presents a problem. Friction against large blade surfaces creates unnecessary drag that quickly uses up stored kinetic energy. There is a long felt need for a hunting arrowhead having minimal size blades and an effective configuration which will employ them to efficiently cut a wide maximum path with extended depth penetration.

The Doonan mechanism derives its blade opening force from the pressure against the arrowhead as it penetrates. As mentioned before, it lacks sufficient camming leverage to open its blades to a wide cutting diameter. It is also important to point out that it provides only minimal mechanical leverage to hold its blades open as it penetrates. It is objectionable that the Doonan mechanism may not have the ability to open its blades on impact, before penetration. It is even more objectionable when the ability to create a wide exterior cut becomes less certain as the blades may lack sufficient leverage to stay open when expected to cut.

The blades in the Doonan mechanism may be forced to retract when they encounter denser unyielding materials such as tough hide or bone, and have the potential to reopen upon entering more penetrable matter. However it is objectionable that this mechanism has no certain minimal cutting diameter. It is also objectionable that if the head itself were to strike bone, the blades cannot readily retract. In this case increased leveraging force will unnecessarily urge the blades to cut wide as the body wedges through thereby inefficiently using the stored kinetic energy in a decelerating arrow which may have been saved for further cutting and penetration.

Accordingly, there is need for an improved hunting arrowhead which is capable of efficiently creating a wide exterior cut on entry, having retractility of blades to a minimum cutting width to enable more effective penetration on bone, and being further capable of wide cutting after passing through the bone while maintaining the ability to be easily withdrawn.

Examples of exposed blade hunting arrowhead mechanisms which are intended to open wider on or after impact are presented in U.S. Pat. Nos. 4,099,720 of Zeren and 4,452,460 of Adams. These present the same aerodynamic instability problems as exposed fixed blade hunting arrowheads during flight and are likewise objectionable as they cannot eliminate windplaning.

Other prior art hunting arrowhead developments that have been directed toward mechanisms having completely enclosed or almost completely enclosed blades are presented in U.S. Pat. Nos. 3,738,657 of Cox and 4,166,619 of Bergmann et al. These mechanisms are intended to open after penetrating through the exterior of the target. They are objectionable due to their inability to produce a wide exterior cut which is necessary for sufficient bleed-out to create a trail essential for tracking in order to properly harvest the game.

SUMMARY OF THE INVENTION

Accordingly, a general object of the invention is to provide an archery arrow having an arrowhead with the mechanical ability to absorb and reduce the shock of the inertial forces exerted upon the arrow shaft during acceleration, thereby enabling the use of a lower spine and lighter shaft for increased speed and accuracy.

Another general object of the invention is to provide an archery arrow having a hunting arrowhead that attains maximum speed, accuracy, cutting, penetration, shock, hemorrhaging and bleed-out.

A more specific object of the invention is to provide an improved hunting arrowhead having impact opening blades that are enclosed during flight thereby completely eliminating windplaning and enabling the use of standard target arrow fletching.

Another object of the invention is to provide an impact opening hunting arrowhead which insures proficient instant broad opening on impact, prior to penetration, and efficiently produces a wide exterior cut upon entry, without respect to where it strikes the game, wherein pressure against the exposed cutting surfaces of the blades assists in mechanically leveraging them to cut a wide path, while further having a minimum cutting width when penetrating bone, as well as wide cutting after passing through the bone, with free movement and retractility of blades facilitating removal of the arrowhead from game and therefore not constituting a barbed arrowhead.

A further object of the invention is to provide an improved hunting arrow having an arrowhead configured to provide a less restrictive path for the arrow shaft, as well as having increased proficiency when penetrating bone.

Briefly, an improved arrow in accordance with a general aspect of the invention comprises an arrow shaft with an arrowhead and means for providing a portion of the arrowhead to have relative rearward movement with respect to the arrow shaft during acceleration, and passive resistant means for absorbing and thereby reducing the shock of the inertial forces exerted by the mass of the moving parts upon the arrow shaft during acceleration.

In accordance with a more specific embodiment of the invention the hunting arrowhead consists of a hollow elongated body having a rearward base with a first axial slit through its wall extending from the base to a point near its forward end. A punching slide pin is slidably received in the hollow elongated body and has a second axial slit aligned with the first slit. Two blades are rotatively mounted on the punching slide pin and adapted to rotate outwardly around a pivot point through the aligned first and second axial slits. The blades have a forward portion forward of the pivot point and a rearward portion rearward of the pivot point. A first stage opening cam portion is on the rearward end of each blade and a second stage maximum leveraging cam portion is on the forward end of each blade. Resilient passive resistant means engage the blades rearward of the pivot point for gently urging the blades to an enclosed forward retracted position within the hollow elongated body. When the arrowhead is accelerated, the hollow elongated body moves forward with respect to the punching slide pin urging the first stage cam portions of the blades against the base of the hollow elongated body thereby rotating the blades against the resilient passive resistant means through the first and second axial slits outwardly from the hollow elongated body, thereby dampening the inertial forces and reducing the shock exerted by the mass of the combined punching slide pin - cam blades assembly upon the arrow shaft which decreases its bending during acceleration. The energy stored in the resilient passive resistant means during acceleration immediately retracts the blades to the enclosed position within the narrow aerodynamic body profile as flight begins to the target.

A hunting arrow for maximizing penetration, shock, hemorrhaging and bleed-out, in accordance with another embodiment of the invention, compromises an arrow shaft having an arrowhead with a graduated step punch configuration consisting of a first inclined step on the forward end of the arrowhead having a given leading taper angle adapted to force matter forward and to the side rather than separate the matter, followed by a first straight portion parallel to the center axis of the arrowhead having a given diameter, wherein the length of the straight portion is at least a given number times its diameter, followed by a second inclined step beginning at the rearward end of the first straight portion having a given taper angle adapted to force matter forward and to the side rather than separate the matter, followed by a second straight portion parallel to the center axis of the arrowhead body having a given diameter, wherein the length of the second straight portion is at least a given number times the diameter, and a third inclined step beginning at the rearward end of the second straight portion having a given taper angle adapted to force matter forward and to the side rather than separate the matter, which continues to the outer diameter of the arrowhead body. This graduated step punch configuration creates a less restricted path for the arrowhead and shaft by forcing matter forward and clearing it to the side, thereby maximizing penetration, shock, hemorrhaging and bleed-out.

A particularly unique feature of the present invention is the relative rearward movement of parts against passive resistance which absorbs and reduces the inertial shock exerted by the mass of these relative rearward moving parts upon the arrow shaft during acceleration, thereby overcoming prior art problems.

Another unique feature of the present invention is the incorporation of two-stage cam leverage of the blades. The first stage overcomes prior art problems by providing efficient means to insure both instant broad opening on impact, prior to penetration, and a wide exterior cut upon entry, without respect to where it strikes the game. The second leveraging stage overcomes prior art problems by providing the mechanical ability of the blades to retract to a predetermined minimum cutting width when penetrating bone, as well as providing proficient leveraging potential to reopen for wide cutting after passing through the bone.

Another feature of the present invention is the complete retractility of its blades when withdrawn. The blades will readily retract forward with no diametric extension beyond the outer diameter of the arrowhead body when drawn rearward thereby facilitating removal so as to cause the least damage to the game.

Yet another feature of the invention is a hunting arrowhead having a reduced overall weight which is exactly equal to that used on target arrows in order that it may be cast on target arrow shafts and further have the speed and accuracy of target arrows.

Still another feature is a matched weight practice or target arrowhead for use as a part of a complete arrow system having the same shock absorbing and flight characteristics as the hunting arrowhead embodiment of the invention.

Another feature is a tournament target point arrowhead for use in said arrow system having the highest level of shock absorbing ability, thereby enabling the use of the lowest spine and lightest arrow shafts for maximum speed and accuracy.

An advantage of the invention is that the summation of these features provides bowhunters with the combined advantages of safe handling, as well as having the uncompromised highest level of swift accurate shot placement achieved by tournament target archers, in addition to the increased overall potential for an arrowhead to produce a quick and humane kill. This ultimately results in the reduction of inaccurate and or ineffective arrow placement which may cause game to suffer needlessly, and reduces the chance of unnecessarily and inhumanely wasting our valuable wildlife resources.

BRIEF DESCRIPTION OF THE DRAWINGS

Other objects, features and advantages of the invention will be apparent from the following detailed Description of the Preferred Embodiments together with the accompanying drawings wherein:

FIG. 1 is an orthographic front view of the complete hunting arrowhead of a hunting arrow in accordance with the preferred embodiment of the invention.

FIG. 2 is an exploded orthographic front view illustrating the broken-out sectioned punching slide pin - cam blades assembly A, and broken-out sectioned main body of the hunting arrowhead embodiment shown in FIG. 1.

FIG. 2A is an orthographic side view depicting the main body of the hunting arrowhead taken along line 2A—2A of FIG. 2.

FIG. 2B is an orthographic side view depicting the punching slide pin of the hunting arrowhead taken along line 2B—2B of FIG. 2.

FIG. 6 is an orthographic broken-out and sectioned front view of a matched weight target arrowhead in accordance with another embodiment of the invention which is part of the complete arrow system.

FIG. 7 is an orthographic sectioned front view of a tournament target point arrowhead in accordance with still another embodiment of the invention which is part of the complete arrow system.

DESCRIPTION OF THE PREFERRED EMBODIMENTS

Figure 3:
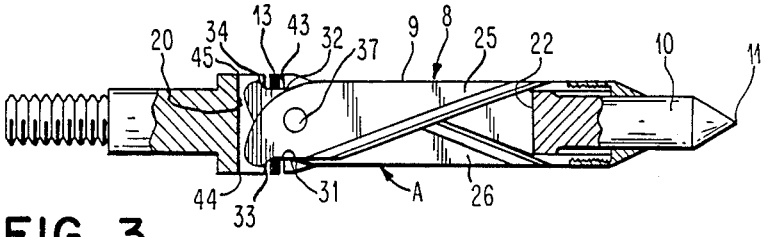
FIG. 3 is an orthographic front view of the hunting arrowhead of FIG. 1, with the main body and punching slide pin broken-out, to depict the punching slide pin - cam blades assembly A in the enclosed position.

As noted above, a problem associated with hunting arrowheads is that they are not capable of being cast with the speed and accuracy of target arrowheads. FIG. 1 illustrates a hunting arrowhead 8 which overcomes prior art problems. Hunting arrowhead 8 incorporates a main body 9 which completely encloses rotating two-stage integral cam blades mounted by means of an axle to a punching slide pin assembly (not shown) whose forward end 10 is seen as having a punching point 11. An end cap 12 slips over the punching point 11 and forward end 10 of the enclosed punching slide pin, two-stage cam blades and axle assembly, and retains said assembly within. In use, an elastic band 13 is placed over the main body to gently urge the enclosed two-stage cam blades to remain enclosed during flight.

Rearward threaded extension 14 is used for mounting the arrowhead to the end of an arrow shaft.

It is seen that windplaning problems are eliminated as this configuration maintains a narrow aerodynamically stable profile, while greatly reducing air drag in flight. This in turn rules out the need for large fletching typically seen on hunting arrows, which may now be replaced with considerably smaller target arrow fletching having less weight and drag. The elimination of windplaning, in combination with reduced weight and drag, thereby elevates speed and accuracy.

Hunting arrowhead 8 further overcomes prior art problems as its configuration is designed to clear a less restrictive path for itself and the shaft it is mounted on, thereby reducing drag for increased penetration through the intended target. Further still, the configuration of hunting arrowhead 8 provides increased efficiency to create a path through bone. The specific form of this embodiment enables it to function as a graduated step punch. This is a complete departure from prior art configurations which have been designed to wedge through, rather than punch an opening. In the past, arrowhead designs were thought to penetrate best by wedging with long narrow tapered profiles. It was taught that the best profiles were those that were one third as wide as they were long. These profiles only part matter as they penetrate, therefore the arrowhead and shaft must squeeze through with considerable friction against their surfaces.

Arrowhead configurations which have traditionally incorporated narrow tapering points, or blades on their leading end are only efficient on softer matter. In order to penetrate denser material such as bone, they require the use of substantially more of the stored kinetic energy in a decelerating arrow. Since it is highly probable that an arrowhead will strike bone which is the greatest obstacle to arrow penetration, it is imperative that an arrowhead be able to penetrate this material most efficiently.

Narrow tapered arrowhead profiles generate considerable wedging friction which quickly dissipates the stored kinetic energy in a decelerating arrow, thereby reducing its forward thrust as it parts a path through bone by directing much of its force outward. This redirecting of the arrows energy cushions its impact and reduces its shock potential to clear a path through. For example, compare a water balloon and a brick having the same weight and velocity when striking a pane of glass. Although they possess the same kinetic energy, they have vastly different abilities to penetrate, especially in the case of dense material. Naturally, the water balloon may burst, directing much of its force outward, therefore causing only minimal impact shock to break through the glass. If the velocity of the water balloon is minimal, it may only distort outward when striking the glass, thereby gradually dissipating its forward thrust and cushioning its shock enough for it to actually bounce off without bursting. The brick, on the other hand, will direct almost all of its energy forward, having considerable shocking potential to break right through the glass.

The punching point 11 of the hunting arrowhead 8 in FIG. 1 has an extremely steep punch point angle shown as sixty degrees, which is the included angle formed by both thirty degree angles with reference to the longitudinal centerline axis bisecting this first step. A second step 15 is shown on the end cap 12 with yet another steep angle shown as fifty degrees, which is the included angle formed by both twenty-five degree angles with reference to the longitudinal centerline axis bisecting this step. Located on the main body 9 is a third step 16 with still another steep angle shown as forty degrees, which is the included angle formed by both twenty degree angles with reference to the longitudinal centerline axis bisecting this step. These steep punch angles on the graduated step punch cause matter to be forced forward and cleared to the side of the arrowhead 8 while it penetrates, thereby creating a less restrictive path for the arrowhead 8 and shaft which follows, as well as providing increased efficiency to create a path through bone.

An arrowhead with a continuous steep angled point taper that extends to the outer diameter of the arrow shaft will normally have a great deal of difficulty passing through the hide on many game animals. This is due to the fact that hide is extremely tough and elastic, which enables it to cushion the impact of a decelerating arrow's force when exerted over a large surface area.

The incorporation of the series of steps in the steep angled graduated step punch configuration of the hunting arrowhead 8 depicted in FIG. 1 thereby enable it to efficiently punch through tough hides as well as muscle and bone. The punching point 11 is the first of the graduated steps. Its narrow diameter constitutes a very small surface area which permits it to easily punch through hide. Placing the steepest angle on this step causes it to efficiently force matter forward and to the side, thereby clearing the greatest amount of material from the path of the arrowhead and shaft, even though it is the smallest in diameter. When punch point 11 encounters bone, it easily shatters a hole through the bone with the highest level of efficiency as it directs almost all of its energy forward. The successive steps in the punch configuration serve to efficiently widen and clear an even less restrictive path. Extensive field testing has proven this graduated step punch feature of the invention to be most effective on penetrating bone.

Experimentation with various punch step angles, diameters and lengths between steps, has established the basis for the graduated punch step configuration of the hunting arrowhead 8. The first inclined step on the punching point 11 is the most important as it is expected to clear the greatest amount of matter from the path of the arrowhead and shaft while having the smallest diameter. This first inclined step 11 functions best when it has a taper angle of not less than substancially sixty degrees, followed by a straight portion parallel to the center axis of the arrowhead having a diameter more than substancially fifty percent of the largest diameter of the arrowhead body. The length of the straight portion which follows the first inclined step should not be not less than substancially one and one quarter times its diameter. This length allows enough distance for the second inclined step 15 to avoid contact with the wake of matter that has been cleared by the first inclined step on the punching point 11. The second inclined step 15 begins at the rearward end of the straight portion and should have a taper angle of not less than substancially fifty degrees. The taper angle of the second inclined step 15 may continue to the outer diameter of the arrowhead body (not shown) and thereby provide a graduated step punch configuration capable of improved penetration. Experimentation during the development of the graduated step punch configuration for hunting arrowhead 8 proved the three step configuration to be capable of providing the greatest combination of advantages. The second inclined step 15 on the hunting arrowhead 8 is followed by a second straight portion parallel to the center axis of the arrowhead having a diameter more than substancially eighty percent of the largest diameter of the arrowhead's main body 9. The length of this second straight portion should be at least substancially one and one half times its diameter. This length allows enough distance for the third inclined step 16 to avoid contact with the wake of matter that has been cleared by the second inclined step 15. The length of the second straight portion which follows the second inclined step 15 on hunting arrowhead 8 has been extended to substancially three and one half times its diameter. This permits the main body 9 to have a reduced weight in the area where the blades (not shown) are enclosed. The third inclined step 16 begins at the rearward end of the second straight portion and should have a taper angle of not less than substancially forty degrees, which continues to the outer diameter of the main body 9 of hunting arrowhead 8.

Prior art wedge shaped arrowheads, configured to part a path through, have been known to cause very little shock on impact with the intended game. The present invention overcomes this problem by transmitting greater shock to the impact area as it punches through, forcing matter in its path forward and to the side. The hole clearing ability of this configuration causes extensive hemorrhaging as the arrowhead continues to penetrate. Massive bleed-out occurs as the blood has a readily cleared path to escape through, thereby facilitating tracking of the game, and further insuring a quick kill.

A more detailed disclosure of the hunting arrowhead 8 is illustrated in FIG. 2. The main body 9 is seen as having a hole 17 drilled from its forward end to a point in depth located at 18. FIG. 2A further depicts the side view of the main body 9 taken along line 2A—2A. It illustrates a saw slit 19 cut through the center axis of the main body 9 from its forward end. Indicated on the main body 9, is the base 20 (FIG. 2) at the bottom of the saw slit 19.

FIG. 2B depicts the side view of the punching slide pin 10 taken along line 2B—2B. It illustrates a similar saw slit 21 cut through the center axis of the punching slide pin 10, from its rearward end. The base of this slit is indicated on the punching slide pin 10 at 22. Also indicated by FIG. 2B is axle hole 23 that is perpendicular to the slit 21. This axle hole is further depicted on the punching slide pin 10 as being located at 24.

Blades 25 and 26 (FIG. 2) incorporate two-stage integral cams with first stage impact opening cam segments 27 and 28, second stage maximum leveraging cam segments 29 and 30, rearward shoulders 31 and 32, band retaining ridges 33 and 34, and axle pivot holes 35 and 36. These two-stage integral cam blades 25 and 26 are inserted into the slit 19 (FIG. 2A) of the punching slide pin 10 (FIG. 2) and stacked opposing each other with their cutting edges facing inward. Axle 37 is placed through the axle hole 24 in the punching slide pin 10, and also through blade axle pivot holes 35 and 36, thereby forming the punching slide pin, two-stage cam blade and axle assembly A.

End cap 12 is shown with hole 38 through its axial center, which enables it to be slipped over the forward end of the punching slide pin - cam blades assembly A. The retaining shoulder 39 on the punching slide pin 10 limits how far the pin may pass through the end cap 12, as it will eventually come in contact with the shoulder stop 40 on the interior of the end cap 12. Threads 41 are also located on the interior of the end cap 12.

Continuing with FIG. 2, this embodiment of a hunting arrowhead may be easily constructed by first aligning the blades 25 and 26 with the slit 19 in the main body 9, and sliding the punching slide pin - cam blades assembly A in. The end cap 12 is then slipped over the punching point 11 of the slide pin 10, and tightened by threading onto exterior threads 42, which are located on the forward end of the main body 9. With the blades 25 and 26 held in the enclosed position, a highly elastic band 13 (FIG. 1), having minimal passive retentive ability, is stretched over, and then rolled down the main body 9 until it falls into groove 43 (FIG. 2), thereby gently urging the blades 25 and 26 to remain enclosed within the main body 9 during flight.

The constructed hunting arrowhead embodiment of the present invention is further disclosed in FIG. 3. The tips of the two-stage integral cam blades 25 and 26 are depicted in the enclosed position, and shown as resting against the outer diameter of the punching slide pin 10 at the base of its slit located at 22. Blades 25 and 26 may freely rotate outward from the main body about axle 37. Elastic band 13 is located in groove 43 and rests on rearward blade shoulders 31 and 32 located just in front of retaining ridges 33 and 34. The minimal passive resilient pressure exerted by the elastic band 13 on the rearward portion of the blades 25 and 26 creates a scissor like action about axle 37 which thereby gently urges the forward tips inward.

Figure 4:
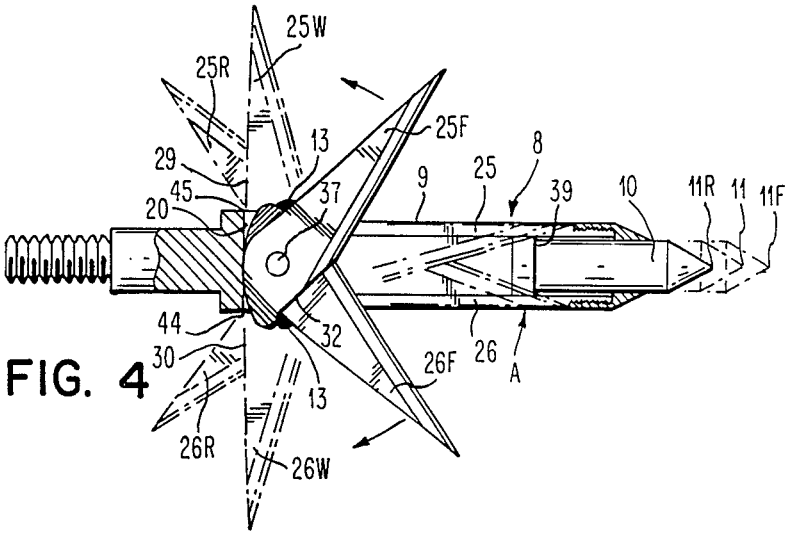
FIG. 4 is an orthographic broken-out and sectioned front view, illustrating the various positions of the punching slide pin - cam blades assembly A within the main body and depicting the assembly A pressed back into the most inward position within the main body, with the blades in the open forward orientation.

Movement of the punching slide pin - cam blades assembly A of the hunting arrowhead 8 is disclosed in FIG. 4. As previously mentioned, a problem associated with past hunting arrowhead designs utilizing moveable blades has been devising a mechanism which can efficiently open its blades from an enclosed position to a wide cutting position on impact, prior to penetration, in order to insure a wide exterior cut, without regard to where it strikes the game. This is a critical issue, and has proven to be one of the most significant aspects of this embodiment of the invention.

Mechanisms which incorporate parts that are meant to be pressed back into the arrowhead to open blades on impact have had inherent problems in the past. This stems from the fact that inertial forces during acceleration cause these moveable parts to stay at rest as the arrowhead body pushes up against them thereby exerting force to open the blades. Whatever force is used to hold the blades closed during acceleration to prevent them from being open during flight must therefore be overcome for them to open on impact. It is important at this time to make a distinction between acceleration and flight. Acceleration begins upon release of the bowstring when the stored energy within the limbs of the bow is transferred to propel the arrow forward. When the bowstring comes to rest, acceleration ends. Flight begins as soon as the arrow leaves the bowstring. The arrow also begins to decelerate the moment it is launched into flight.

In order to create the most sensitive and efficient means requiring the least amount of stored kinetic energy to open the blades on impact, prior to penetration of the intended game, the present invention discloses a mechanism which is devised to function differently, thereby overcoming prior art objections. Hunting arrowhead 8 (FIG. 3) is intentionally designed to cause the mass of the punching slide pin - cam blades assembly A to move rearward relative to the arrow during acceleration. Its blades 25 and 26 actually open during acceleration, close instantly as flight begins, and open on impact before penetration.

FIG. 4 illustrates in the various positions of the punching slide pin - cam blade assembly A emplacement, as the arrowhead 8 goes from acceleration through flight, impact, entry, penetration through bone, and continued penetration through game. In use, at full draw, when the arrowhead 8 is at rest before the shot, the punching point is located in the central position 11, and two-stage integral cam blades 25 and 26 are aligned in the enclosed position. This is similar to the emplacement of parts as depicted in FIG. 3. At the moment the archer releases the arrow, it accelerates the main body 9. Inertia causes the entire mass of the punching slide pin - cam blades assembly A to momentarily stay at rest as the main body 9 accelerates forward thereby forcibly engaging the base 20 (FIG. 4) at the bottom of the saw slit 19 (FIG. 2A) with the first stage impact opening blade cam segments 27 and 28 (FIG. 2). This engagement causes the tips of the blades to rotate open to the forward swept position as depicted at 25F and 26F, while simultaneously permitting the punching slide pin - cam blades assembly A to move rearward relative to the main body 9, with the punching point being located at rearward position 11R. Highly elastic band 13, having only minimal passive resistance and being located close to the axle so as to provide the least counteracting leverage, readily stretches until it reaches retaining ridges 33 and 34, thereby preventing the blades from opening wider. The energy that was stored in the elastic band 13 during acceleration as the blades 25 and 26 opened, immediately closes them when the bowstring comes to rest and the arrow leaves the string. At this point the arrowhead 8 begins flight with the blades 25 and 26 enclosed, and the punching point is moved forward to its original central position 11.

The incorporation of relative rearward movement of parts in this embodiment with respect to the shaft it is mounted on during acceleration is further intended to provide additional advantages overcoming prior art objections. Enabling the mass of the punching slide pin - cam blades assembly A to move rearward against the passive resistance provided by the elastic band's resilient cushioning during acceleration greatly reduces the inertial shock transmitted to the arrow shaft as it is propelled. By minimizing the shock to the arrow shaft which carries arrowhead 8, the arrow shaft will distort less during acceleration thereby increasing accuracy in flight as well as reducing aerodynamic drag which will serve to further increase speed. This cushioning effect also enables the use of lower spine, lighter arrow shafts which may be shot at higher speeds.

When the punching point 11 (FIG. 4) of the punching slide pin - cam blades assembly A impacts with the game, its forward travel will be impeded readily due to its minimal overall mass. Once again the main body 9 will push forward forcibly engaging the base 20 with first stage, impact opening, blade cam segments 27 and 28. The engagement of the cams 27 and 28 will proficiently rotate the blades 25 and 26 open again to the forward swept orientation depicted at 25F and 26F, as they have minimal mass, and the elastic band 13 will again stretch with only minimal passive resistance until reaching retaining ridges 33 and 34. Again, as the blades 25 and 26 open outward, they will simultaneously permit the punching slide pin - cam blades assembly A to move rearward relative to the main body 9, with the punching point being located at rearward position 11R. This impact opening, first stage of the cam design for blade employment, having minimal passive resistant blade restraint, overcomes prior art objections as it provides the mechanical efficiency to instantly open the blades 25 and 26 to a wider angle on impact, prior to penetration, thereby insuring a large exterior cut, without respect to where the arrowhead strikes the game.

The brief interval of time in which the blades 25 and 26 must open wide before entering the game, is a critical factor which requires the utmost efficiency in a mechanism designed to lever them open. Hunting arrowhead 8 may be cast by a fifty seven pound, standard draw length, round wheel compound bow, so that it reaches a target at twenty yards in less than thirty one hundredths of a second. The main body 9 moves only about 1/16th of an inch forward when the punching slide pin 10 is moved to its relative rearward position as it is slowed during impact. It is during the time it takes the arrow to travel this 1/16th of an inch that the blades 25 and 26 must open wide before penetrating. This requires that the mechanism be efficient enough to open the blades 25 and 26 in only 26.9 millionths of a second. The tips of the blades must actually be accelerated faster than a bullet in order to rotate from their enclosed position to create a wide exterior cut during this minimal instant of time. With this in mind, any resistance to opening must be reduced to an absolute minimum. This embodiment of the invention overcomes prior art objections in this regard by enabling its blades 25 and 26 to open during acceleration, which permits the incorporation of only minimal passive resilient pressure to gently urge them to their enclosed position during flight. It also incorporates the use of minimal size blades which are configured so that they may be readily acclerated to open, and more efficiently cut at a wider angle, while having less surface drag and cutting resistance.

This embodiment of the invention further insures an efficient wide exterior cut on entry during the impact opening, first stage, as its blades 25 and 26 enter the game in the forward swept position 25F and 26F. The sharp tapered points of the blades will easily pierce through tough hide in this forward swept position. A proficient broad exterior opening is created as the blades cut readily from their outer tips inward to the main body.

As the hunting arrowhead 8 further continues to penetrate, the blades 25 and 26 are permitted to open wider, and swing back to their widest position depicted at 25W and 26W, thereby shearing the elastic band 13. This feature overcomes objections to prior art mechanisms which utilize camming leverage that may be insufficient to hold their blades open wide during entry. Since external pressures rotate the blades 25 and 26 back to open wider during entry, they do not require any additional force from the energy stored in the arrow to hold them open, thereby still further insuring an even more efficient wide exterior cut.

When the blades 25 and 26 have swung back to their widest cutting position 25W and 26W, the second blade leveraging stage begins as the maximum leveraging cam segments 29 and 30 engage with outer edges 44 and 45 of the saw slit base 20. Pressure on the punching point 11 as it continues to penetrate thereby causes the blades 25 and 26 to continue to cut by leveraging them toward this widest position. This second leveraging stage overcomes prior art objections as it delivers proficient leveraging potential to hold the blades 25 and 26 open. Punching point 11, which is designed to force matter forward and to the side and thus clear a less restrictive path as mentioned before, is also intentionally designed to work in conjunction with, and thereby improve, the blade cam leveraging ability. This design exerts more pressure to leverage the blades open while efficiently clearing a path, due to its steep angled configuration. Its configuration further enables it to automatically adjust the blade cutting width in proportion to the amount of stored kinetic energy remaining in the arrow, thereby maximizing depth of penetration.

If the arrowhead 8 directly impacts with bone, the punching slide pin first shatters a hole through, which is further widened by the successive graduated punching steps to efficiently clear a path. This feature overcomes prior art objections as it greatly reduces the pressure to hold the blades 25 and 26 open while the body of the arrowhead 8 is penetrating bone. After the punching slide pin 10 has punched through, it will supply less opening leverage as it encounters softer matter, thereby permitting the blades 25 and 26 to retract for more efficient bone penetration. As the pressure of the bone against the blades 25 and 26 becomes greater than that which the punching slide pin 10 is engaging to mechanically leverage them wide, they will angle back to the predetermined minimal cutting width depicted at 25R and 26R, thereby moving the punching point 11 to its forward position located at 11F. The blades 25 and 26 will remain in this position 25R and 26R until they have passed through the bone. At this point, continued pressure against the penetrating punching point 11 will again cause them to open toward their widest cutting position depicted at 25W and 26W.

The minimum cutting width of the blades 25 and 26 is determined by the location of the retaining shoulder 39 (FIG. 4) on the punching slide pin 10. In certain hunting situations it may be desirable to have the blades open on impact, and continue to cut at either a larger or smaller minimal cutting width. If the punching slide pin 10 were replaced with a pin having its retaining shoulder located further forward for example, it would increase the minimal cutting width as this would reduce the forward movement of the pin thereby causing it to hold the blades open wider. Adjustment of the minimal cutting width may also be selected by placing cylindrical spacing rings (not shown) in front of the retaining shoulder 39 on the punching slide pin 10.

Figure 5:
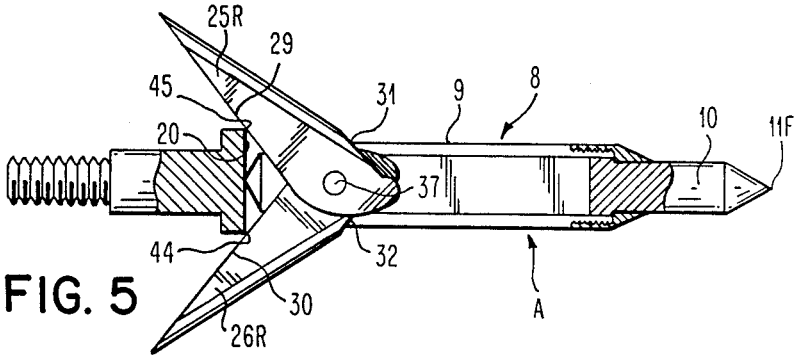
FIG. 5 is similar to FIG. 3 but with the punching slide pin - cam blades assembly A depicted in the forward position, with the blades in the angled back narrowest cutting emplacement.

The second stage, cam leveraging of the blades against the base 20 is further illustrated in FIG. 5. Maximum leveraging cam segments 29 and 30 are shown engaging outer edges 44 and 45 of the base 20. The blades 25 and 26 are depicted in the narrowest cutting position at 25R and 26R. The punching slide pin 10 is shown in the forward position, with its punching point located at 11F. It is clearly seen that by pressing the punching slide pin - cam blades assembly A into the main body 10, the blades 25 and 26 will be levered open. Maximum leveraging of the blades 25 and 26 in this second stage is apparent as the punching slide pin 10 is capable of a long force stroke from the forward position 11F to the rearward position 11R (FIG. 4) which thereby provides an effective mechanical advantage to rotate the blades 25 and 26 open to the widest cutting position 25W and 26W. This embodiment of the invention also incorporates cutting pressure against the blades 25 and 26 themselves to assist in maximizing the leverage to hold them open during this second stage. The outer edges 44 and 45 serve as the fulcrums for leveraging the blades 25 and 26 open. It is seen that blade shoulders 31 and 32 (FIG. 5), are subject to relative rearward pressure resulting from blade cutting drag as the arrowhead penetrates forward. Since blade shoulders 31 and 32 are located between the fulcrum points on the blades 25 and 26, a mechanical leveraging potential exists when rearward pressure is exerted against them. Blade shoulders 31 and 32 are deliberately exposed so that they will provide additional pressure to lever the blades 25 and 26 open. They also serve as a leading chipping edge to further increase the efficiency of the blades to penetrate bone.

When hunting arrowhead 8 is pulled rearward to be withdrawn from game, its blades 25 and 26 will swing forward to their enclosed position, thereby facilitating removal. This feature of the invention further increases the overall potential of this embodiment to be humane as it may also be more easily removed by game that may not have been hit in a vital area.

Efficient use of the stored kinetic energy in a decelerating arrow is greatly increased as the blades 25 and 26 of hunting arrowhead 8 may readily retract to a narrow cutting width while penetrating bone, and again reopen after passing through. Combining a graduated step punch configuration, two stage employment of minimal size blades having reduced cutting drag, with the mechanical capability of the punching slide pin 10 to proportionally adjust cutting width automatically as the arrow loses kinetic energy has proven to enable unsurpassed overall cutting, penetration, shock, hemorrhaging and bleed-out in actual tests on big game.

An alternate embodiment of the present invention is depicted in FIG. 6. This illustration discloses an arrowhead 8T intended for target use. It provides the archer with a practice arrowhead that will have the same shock absorbing and flight attributes of hunting arrowhead 8, but without the blade cutting capability. A typical target point arrowhead may have the same weight, but is incapable of absorbing the shock of its mass when accelerated.

It is seen that the punching slide pin - cam blades assembly A (FIG. 2), has been replaced with matched weight slide pin 46. The mass of lide pin 46 is considerably less than the combined mass of the punching slide pin - cam blades assembly A that it is replacing. It may be made of steel or brass, for example, so that it will match the weight of the entire assembly A. The elastic band 13 (FIG. 1) has also been replaced with spring 47. Spring 47 provides the resilient passive resistance necessary to enable the matched weight slide pin 46 to move rearward relative to the main body 9 during acceleration. The end cap 12 (FIG. 1) has also been replaced with tapered point end cap 48.

When target arrowhead 8T is accelerated, the inertial forces exerted by the matched weight slide pin 46 are dampened by the spring 47 which is compressed as the main body 9 pushes forward. The moment acceleration ends, the spring 47 will give up the energy it stored while absorbing the shock, and press the matched weight slide pin 46 forward to its original position. Target arrowhead 8T will therefore have the same weight as hunting arrowhead 8 and similar ability to absorb and thereby reduce the shock transmitted to the arrow shaft it is mounted on when accelerated.

There is illustrated in FIG. 7, yet another embodiment of the present invention, a tournament target arrowhead 8TT with the highest level of shock absorbing ability, intended for use as a tournament target point.

A hollow cylindrical insertable main body 49 has an outer ridge shoulder 50 located at its forward end. Shoulder 50 serves as a stop, permitting the main body 49 to be inserted within and attached to the end of an arrow shaft by means of a hot gluing method. Spring 51 provides the resilient passive resistance necessary to enable slide pin 52 to move rearward relative to the arrow shaft, thereby absorbing and reducing shock to the arrow shaft during acceleration.

Assembly of tournament target point arrowhead 8TT is accomplished by sliding the spring 51 into the main body 49, followed by the slide pin 52. Bullet point end cap 53, having external threads 54, is then screwed into internal threads 55, located on the end of the main body 49.

When the insertable main body 49 and bullet point end cap 53 are constructed of aluminum, for example 7075 with a T6 temper, they constitute a very minimal part of the overall weight of tournament target arrowhead 8TT. The slide pin is intended to comprise the largest percentage of the arrowhead's weight, thereby enabling the highest level of shock to be cushioned by the spring 51. The slide pin 52 is made of brass for example, which has a high weight to mass ratio. This enables the slide pin 52 to take up very little space within the insertable main body 49, thereby increasing the space available to permit the use of a spring 51 having maximum length and shock dampening capacity.

Figure 8:
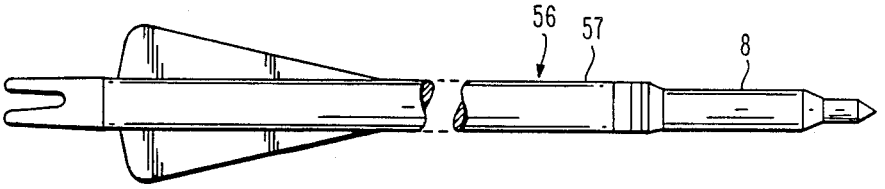
FIG. 8 is an orthographic view of an arrow and hunting arrowhead embodiment of the invention.
Figure 9A:
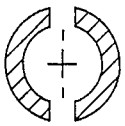
FIGS. 9A, 9B, 9C and 9D are a production drawing depicting the dimensional relationships of the best mode of construction for the main body, end cap and punching slide pin of the hunting arrowhead portion of the invention.
Figure 9B:
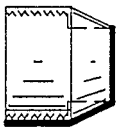
Figure 9C:
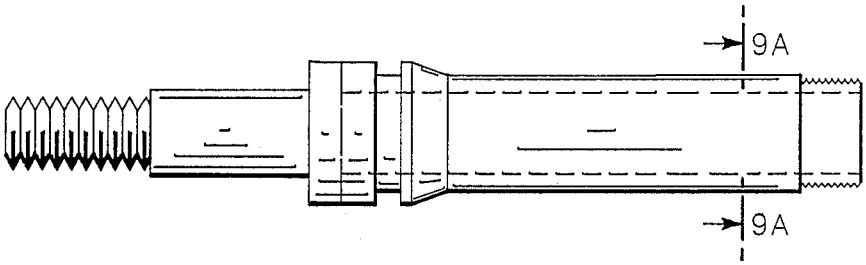
Figure 9D:
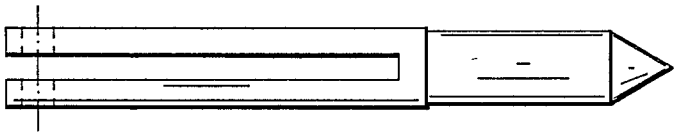

FIG. 8 illustrates a hunting arrow located generally at 56. It includes the hunting arrowhead 8 mounted to an arrow shaft 57.

FIG. 9 discloses the preferred best mode of the hunting arrowhead embodiment 8 of the present invention so that it may be constructed to weigh exactly the same as a screw in replaceable target point arrowhead. The body parts including the punching slide pin, main body, and end cap, may be manufactured from high grade aircraft aluminum, for example 7075 with a T6 temper. The blades, and axle pin may be made of tempered steel for example. These materials were used in prototypes of the hunting arrowhead embodiment which weighed only seventy five grains.

Construction of the two-stage integral cam blades in the preferred best mode may be accomplished by utilizing 0.025" stainless or high carbon steel. Disclosure of the blade configuration is provided in the following list of coordinates which define its contour for production with a CAM operated wire EDM cutting machine.

1. N010G00X0.Y0
2. N020G43Z0
3. N030G81G98X0.Y0.Z0.R0
4. N040X.6Y.221
5. N050X.65Y.238
6. N060X.7Y.253
7. N070X.75Y.268
8. N080X.8Y.238
9. N090X.85Y.295
10. N100X.87Y.3
11. N110X.8719Y.3005
12. N120X.8806Y.303
13. N130X.8828Y.3036
14. N140X.885Y.304
15. N150X.89
16. N160X.895
17. N170X.8989Y.3038
18. N180X.9005Y.3034
19. N190X.904Y.302
20. N200X.908Y.3
21. N210X.953Y.275
22. N220X.992Y.25
23. N230X1.019Y.255
24. N240X1.04Y.2
25. N250X1.058Y.175
26. N260X1.072Y.15
27. N270X1.089Y.125
28. N280X1.093Y.1
29. N290X1.097Y.085
30. N300X1.045Y.067
31. N310X1.04Y.076
32. N320X1.03Y.081
33. N330X1.02Y.082
34. N340X1.01Y.079
35. N350X1.Y.075
36. N360X.975Y.066
37. N370X.956Y.059
38. N380X.8Y.081
39. N390X.775Y.013
40. N400X.75Y.008
41. N410X.725Y.004
42. N420X.7Y.002
43. N430X.675Y0.
44. N440G80
45. N450M30
46. N460%

The target point arrowhead weight of hunting arrowhead 8 enables it to be mounted on a considerably lighter target arrow shaft. A 2114 aluminum shaft, for example, may be used with a 60 pound compound bow. Standard target arrow fletching may also be used, as windplaning has been eliminated. In effect, hunting arrowhead 8 may be cast with at least the same degree of accuracy, and speed as a target arrowhead.

It should be obvious that changes, additions and omissions may be made in the details and arrangement of parts without departing from the scope of the invention as defined in the appended claims.

What is claimed is:

1. A hunting arrow for maximizing penetration, shock, hemorrhaging and bleed-out comprising:

(a) an arrow shaft;

(b) an arrowhead connected to said arrow shaft;

(c) said arrowhead having a graduated step punch configuration comprising (1) a first inclined step on the forward end of said arrowhead having a first taper angle of not less than substantially sixty degrees, which is the included angle formed by both thirty degree angles with reference to the longitudinal centerline axis bisecting said first inclined step, adapted to force matter forward and to the side rather than separate the matter, followed by a straight portion parallel to the center axis of said arrowhead; and (2) a second inclined step beginning at the rearward end of said straight portion having a second taper angle adapted to further force matter forward and to the side rather than to separate the matter;

(d) whereby said graduated step punch configuration creates a less restricted path, with said first inclined step clearing the greatest amount of the matter from the path of said arrowhead and said arrow shaft by directing their kinetic energy to force matter forward and clear it to the side, thereby maximizing penetration, shock, hemorrhaging and bleed-out.

2. A hunting arrow for maximizing penetration, shock, hemorrhaging and bleed-out according to claim 1 wherein:

(1) said straight portion has a diameter more than a first given percent of the total diameter of said arrowhead graduated step punch configuration, wherein the length of said straight portion is at least a first given number of times the diameter of said straight portion;

(2) said second inclined step beginning at the rearward end of said straight portion has a taper angle of not less than a second given angle.

3. A hunting arrow for maximizing penetration, shock, hemorrhaging and bleed-out according to claim 1 wherein:

(1) said straight portion has a diameter more than substantially fifty percent of the total diameter of said arrowhead graduated step punch configuration, and wherein the length of said straight portion is at least one and one quarter times the diameter of said straight portion.

(2) said second taper angle of said second inclined step is not less than substantially fifty degrees, which is the included angle formed by both twenty-five degree angles with reference to the longitudinal centerline axis bisecting said second inclined step.

4. A hunting arrow for maximizing penetration, shock, hemorrhaging and bleed-out comprising:

(a) an arrow shaft;

(b) an arrowhead connected to said arrow shaft;

(c) said arrowhead having a graduated step punch configuration comprising (1) a first inclined step on the forward end of said arrowhead having a first taper angle adapted to force matter forward and to the side rather than separate the matter, followed by a first straight portion parallel to the center axis of said arrowhead;

(2) a second inclined step beginning at the rearward end of said straight portion having a second taper angle adapted to further force matter forward and to the side rather than to separate the matter, followed by a second straight portion parallel to the center axis of said arrowhead;

(3) a third inclined step beginning at the rearward end of said second straight portion having a third taper angle adapted to still further force matter forward and to the side rather than separate the matter;

(d) whereby said graduated step punch configuration creates a less restricted path, with said first inclined step clearing the highest percentage of the matter, for said arrowhead and said arrow shaft by forcing matter forward and clearing it to the side, thereby maximizing penetration, shock, hemorrhaging and bleed-out.

5. A hunting arrow for maximizing penetration, shock, hemorrhaging and bleed-out according to claim 4 wherein:

(1) said first taper angle of said first inclined step is not less than substantially sixty degrees, which is the included angle formed by both thirty degree angles with reference to the longitudinal centerline axis bisecting said first inclined step, and said first straight portion has a diameter more than substantially fifty percent of the total diameter of said arrowhead graduated step punch configuration, wherein the length of said first straight portion is not less than substantially one and one quarter times the diameter of said first straight portion;

(2) said second taper angle of said second inclined step is not less than substantially fifty degrees, which is the included angle formed by both twenty-five degree angles with reference to the longitudinal centerline axis bisecting said second inclined step, and said second straight portion has a diameter more than substantially eighty percent of the total diameter of said arrowhead graduated step punch configuration, and wherein the length of said second straight portion is not less than substantially one and one half times the diameter of said second straight portion; and (3) said third taper angle of said third inclined step is not less than forty degrees, which is the included angle formed by both twenty degree angles with reference to the longitudinal centerline axis bisecting said third inclined step.

6. A hunting arrow for maximizing penetration, shock, hemorrhaging and bleed-out comprising:

(a) an arrow shaft;

(b) an arrowhead connected to said arrow shaft;

(c) means for providing a portion of said arrowhead to have relative rearward movement with respect to said arrow shaft during acceleration;

(d) passive resistant means for absorbing and thereby reducing the shock of the inertial forces exerted by the mass of said relative rearward moving arrowhead portion upon said arrow shaft during acceleration;

(e) said arrowhead having a graduated step punch configuration comprising (1) a first inclined step on the forward end of said arrowhead having a first taper angle adapted to force matter forward and to the side rather than separate the matter, followed by a straight portion parallel to the center axis of said arrowhead; and (2) a second inclined step beginning at the rearward end of said straight portion having a second taper angle adapted to further force matter forward and to the side rather than to separate the matter;

(f) whereby said graduated step punch configuration creates a less restricted path, with said first inclined step clearing the greatest amount of the matter from the path of said arrowhead and said arrow shaft by directing their kinetic energy to force matter forward and clear it to the side, thereby maximizing penetration, shock, hemorrhaging and bleed-out.

7. A hunting arrow for maximizing penetration, shock, hemorrhaging and bleed-out according to claim 4 wherein:

(1) said first inclined step on the forward end of said arrowhead has a leading taper angle of not less than substantially sixty degrees, which is the included angle formed by both thirty degree angles with reference to the longitudinal centerline axis bisecting said first inclined step, followed by a first straight portion parallel to the center axis of said arrowhead having a diameter more than a first given percent of the total diameter of said arrowhead graduated step punch configuration, wherein the length of said first straight portion is at least a first given number of times the diameter of said arrowhead graduated step punch configuration; and (2) said second inclined step beginning at the rearward end of said first step straight portion has a taper angle of not less than a second given angle.

8. A hunting arrow for maximizing penetration, shock, hemorrhaging and bleed-out comprising:

(a) an arrow shaft;

(b) an arrowhead connected to said arrow shaft;

(c) means for providing a portion of said arrowhead to have relative rearward movement with respect to said arrow shaft during acceleration;

(d) passive resistant means for absorbing and thereby reducing the shock of the inertial forces exerted by the mass of said relative rearward moving arrowhead portion upon said arrow shaft during acceleration;

(e) said arrowhead having a graduated step punch configuration comprising (1) a first inclined step on the forward end of said arrowhead having a first taper angle adapted to force matter forward and to the side rather than separate the matter, followed by a first straight portion parallel to the center axis of said arrowhead;

(2) a second inclined step beginning at the rearward end of said straight portion having a second taper angle adapted to further force matter forward and to the side rather than to separate the matter, followed by a second straight portion parallel to the center axis of said arrowhead; and (3) a third inclined step beginning at the rearward end of said second straight portion having a third taper angle adapted to still further force matter forward and to the side rather than separate the matter;

(f) whereby said graduated step punch configuration creates a less restricted path, with said first inclined step clearing the greatest amount of the matter from the path of said arrowhead and said arrow shaft by directing their kinetic energy to force matter forward and clear it to the side, thereby maximizing penetration, shock, hemorrhaging and bleed-out.

9. A hunting arrow comprising:

(a) an arrow shaft;

(b) an arrowhead connected to said arrow shaft, said arrowhead comprising (1) a hollow elongated body having a rearward base with a first axial slit through its wall extending from said base to a point near its forward end;

(2) a punching slide pin slidably received in said hollow elongated body and having a second axial slit aligned with first slit;

(3) at least one blade rotatively mounted on said punching slide pin and adapted to rotate outwardly around a pivot point through said aligned first and second axial slits;

(4) said blade having a forward portion forward of said pivot point and a rearward portion rearward of said pivot point;

(5) a first stage opening cam portion on the rearward end of said blade;

(6) a second stage maximum leveraging cam portion on the forward end of said blade;

(7) resilient passive resistant means engaging said blade rearward of said pivot point for gently urging said blade to an enclosed forward retracted position within said hollow elongated body;

(c) whereby when said arrowhead is accelerated, said hollow elongated body moves forward with respect to said punching slide pin urging said first stage cam portion of said blade against said base of said hollow elongated body thereby rotating said blades against said resilient passive resistant means through said first and second axial slits outwardly from said hollow elongated body, thereby dampening the inertial forces that cause said arrow shaft to bend when accelerated.

10. A hunting arrow according to claim 9 wherein said resilient passive resistant means absorbs the shock of the inertial forces exerted by the mass of said blade and said punching slide pin during said acceleration, wherein the resilient aspect of said resilient passive resistant means further permits the energy of the inertial forces absorbed during acceleration to be stored for further use.

11. A hunting arrow according to claim 10, wherein the energy stored during acceleration in said resilient passive resistant means urges said blade back into said hollow elongated body upon deceleration of said arrowhead.

12. A hunting arrow according to claim 9, wherein upon initial impact of said arrowhead with the outer surface of the intended game, said hollow elongated body moves forward with respect to said punching slide pin urging said first stage cam portion of said blade against said base of said hollow elongated body thereby rotating said blade against said resilient passive resistant means through said first and second axial slits outwardly from said hollow elongated body to an open forward entry cutting position prior to penetration.

13. A hunting arrow according to claim 12, wherein upon continued penetration of said arrowhead, said blade is permitted to rotate to its widest cutting position thereby engaging the said second stage maximum leveraging cam segment with the outer edge of said base, whereby continued pressure on said punching slide pin tip levers said blade to cut toward said widest position.

14. A hunting arrow according to claim 13, wherein said arrowhead is configured to hold said blade in an open cutting position, whereby pressure against said blade while cutting will assist in leveraging said blade open to cut a wide path.

15. A hunting arrow according to claim 14, further comprising:

(a) a retaining shoulder ridge located on the forward end of said punching slide pin;

(b) exterior threads on the forward end of said hollow elongated body; (c) an end cap having a hole straight through enabling it to be slidably mounted over the forward end of said punching slide pin, said hole being restricted in size so as to not allow said retaining shoulder ridge on said punching slide pin to pass through, wherein said end cap may be mounted on the forward end of said hollow elongated body by means of threading, thereby restricting the forward movement of said punching slide pin for retention within said hollow elongated body, while also limiting the minimal cutting width of said blade.

16. A hunting arrow according to claim 15, wherein said blade may readily retract to a narrow predetermined cutting width for more efficient penetration through bone after said punching slide pin has passed through.

17. A hunting arrow according to claim 16, whereby when said arrowhead is withdrawn rearward, said blade may rotate forward to a retracted position having no diametric projection beyond the outer diameter of said arrowhead body, thereby facilitating ease of removal and causing the least damage to the game.

18. A hunting arrow according to claim 17, having an arrowhead total weight of not more than 76 grains, matching that which is used for replaceable target point arrowheads, thereby enabling the archer to use the same arrow shaft for hunting as may be used for tournament target competition.

19. The hunting arrow of claim 9 comprising two rotatively mounted blades.

20. The hunting arrow of claim 9 comprising two rotatively mounted identical blades, each operating the same way but in opposite directions.

21. A hunting arrow comprising:

(a) an arrow shaft;

(b) an arrowhead connected to said arrow shaft, said arrowhead comprising (1) a hollow elongated body having a rearward base with a first axial slit through its wall extending from said base to a point near its forward end;

(2) a punching slide pin slidably received in said hollow elongated body and having a second axial slit aligned with first slit;

(3) at least one blade rotatively mounted on said punching slide pin and adapted to rotate outwardly around a pivot point through said aligned first and second axial slits;

(4) said blade having a forward portion forward of said pivot point and a rearward portion rearward of said pivot point;

(5) a first stage opening cam portion on the rearward end of said blade;

(6) a second stage maximum leveraging cam portion on the forward end of said blade;

(7) resilient passive resistant means engaging said blade rearward of said pivot point for gently urging said blade to an enclosed forward retracted position within said hollow elongated body;

(c) whereby when said arrowhead is accelerated, said hollow elongated body moves forward with respect to said punching slide pin urging said first stage cam portion of said blade against said base of said hollow elongated body thereby rotating said blades against said resilient passive resistant means through said first and second axial slits outwardly from said hollow elongated body, thereby dampening the inertial forces that cause said arrow shaft to bend when accelerated;

(d) said arrowhead having a graduated step configuration comprising:

(1) a first inclined step on the forward end of said arrowhead having a first taper angle adapted to force matter forward and to the side rather than separate the matter, followed by a straight portion parallel to the center axis of said arrowhead; and (2) a second inclined step beginning at the rearward end of said straight portion having a second taper angle adapted to further force matter forward and to the side rather than to separate the matter;

(e) whereby said graduated step punch configuration creates a less restricted path, with said first inclined step clearing the highest percentage of the matter, for said arrowhead and said arrow shaft by forcing matter forward and clearing it to the side, thereby maximizing penetration, shock, hemorrhaging and bleed-out.

22. A hunting arrow comprising:

(a) an arrow shaft;

(b) an arrowhead connected to said arrow shaft, said arrowhead comprising:

(1) a hollow elongated body having a rearward base with a first axial slit through its wall extending from said base to a point near its forward end;

(2) a punching slide pin slidably received in said hollow elongated body and having a second axial slit aligned with first slit;

(3) at least one blade rotatively mounted on said punching slide pin and adapted to rotate outwardly around a pivot point through said aligned first and second axial slits;

(4) said blade having a forward portion forward of said pivot point and a rearward portion rearward of said pivot point;

(5) a first stage opening cam portion on the rearward end of said blade;

(6) a second stage maximum leveraging cam portion on the forward end of said blade;

(7) resilient passive resistant means engaging said blade rearward of said pivot point for gently urging said blade to an enclosed forward retracted position within said hollow elongated body;

(c) whereby when said arrowhead is accelerated, said hollow elongated body moves forward with respect to said punching slide pin urging said first stage cam portion of said blade against said base of said hollow elongated body thereby rotating said blades against said resilient passive resistant means through said first and second axial slits outwardly from said hollow elongated body, thereby dampening the inertial forces that cause said arrow shaft to bend when accelerated;

(d) said arrowhead having a graduated step configuration comprising:

(1) a first inclined step on the forward end of said arrowhead having a first taper angle adapted to force matter forward and to the side rather than separate the matter, followed by a first straight portion parallel to the center axis of said arrowhead;

(2) a second inclined step beginning at the rearward end of said second step straight portion having a second taper angle adapted to further force matter forward and to the side rather than to separate the matter, followed by a second straight portion parallel to the center axis of said arrowhead; and (3) a third inclined step beginning at the rearward end of said second straight portion having a third taper angle adapted to still further force matter forward and to the side rather than separate the matter;

(e) whereby said graduated step punch configuration creates a less restricted path, with said first inclined step clearing the highest percentage of the matter, for said arrowhead and said arrow shaft by forcing matter forward and clearing it to the side, thereby maximizing penetration, shock, hemorrhaging and bleed-out.

23. A tournament target point arrowhead comprising:

(a) a hollow elongated body having internal threads and an external shoulder stop on its forward end, thereby facilitating mounting of said hollow elongated body within the forward end of a hollow arrow shaft;

(b) a slide pin slidably mounted within said hollow elongated body, wherein the weight of said slide pin constitutes at least seventy percent of the total weight of the entire arrowhead;

(c) an end cap for retaining said slide pin within said hollow elongated body, whereby said end cap may be mounted to the end of said hollow elongated body by means of threading;

(d) resilient passive resistant means for urging said slide pin in a forward position before being shot, and adapted to dampen the shock of the inertial forces exerted on the arrow shaft by said slide pin during acceleration;

(e) whereby when said arrowhead is accelerated, said hollow elongated body moves forward with respect to said slide pin against said resilient passive resistant means thereby providing a tournament target point arrowhead having a high level of shock absorbing ability while dampening the inertial forces that cause an arrow shaft to bend when accelerated.

24. A hunting arrowhead adapted to be attached to the end of an arrow shaft for maximizing penetration, shock, hemorrhaging and bleed-out comprising:

(a) a graduated step punch configuration comprising:

(1) a first inclined step on the forward end of said arrowhead having a first taper angle of not less than substantially sixty degrees, which is the included angle formed to both thirty degree angles with reference to the longitudinal centerline axis bisecting said first inclined step, adapted to force matter forward and to the side rather than separate the matter, followed by a straight portion parallel to the center axis of said arrowhead; and (2) a second inclined step beginning at the rearward end of said straight portion having a second taper angle adapted to further force matter forward and to the side rather than to separate the matter;

(b) whereby said graduated step punch configuration creates a less restricted path, with said first inclined step clearing the greatest amount of the matter from the path of said arrowhead and said arrow shaft by directing their kinetic energy to force matter forward and clear it to the side, thereby maximizing penetration, shock, hemorrhaging and bleed-out.

25. A hunting arrowhead having a graduated step punch configuration for maximizing penetration, shock, hemorrhaging and bleed-out according to claim 24, wherein:

(1) said straight portion has a diameter more than substantially fifty percent of the total diameter of said arrowhead graduated step punch configuration, and wherein the length of said straight portion is not less than substantially one and one quarter times the diameter of said straight portion;

(2) said second taper angle of said second inclined step is not less than substantially fifty degrees, which is the included angle formed by both twenty-five degree angles with reference to the longitudinal centerline axis bisecting said second inclined step.

26. A hunting arrowhead adapted to be attached to the end of an arrow shaft, for maximizing penetration, shock, hemorrhaging and bleed-out comprising:

(a) a graduated step punch configuration comprising:

(1) a first inclined step on the forward end of said arrowhead having a first taper angle adapted to force matter forward and to the side rather than separate the matter, followed by a first straight portion parallel to the center axis of said arrowhead;

(2) a second inclined step beginning at the rearward end of said straight portion having a second taper angle adapted to further force matter forward and to the side rather than to separate the matter, followed by a second straight portion parallel to the center axis of said arrowhead;

(3) a third inclined step beginning at the rearward end of said second straight portion having a third taper angle adapted to still further force matter forward and to the side rather than separate the matter;

(b) whereby said graduated step punch configuration creates a less restricted path, with said first inclined step clearing the greatest amount of the matter from the path of said arrowhead and said arrow shaft by directing their kinetic energy to force matter forward and clear it to the side, thereby maximizing penetration, shock, hemorrhaging and bleed-out.

27. A hunting arrowhead having a graduated step punch configuration for maximizing penetration, shock, hemorrhaging and bleed-out according to claim 26, wherein:

(1) said first taper angle of said first inclined step is not less than substantially sixty degrees, which is the included angle formed by both thirty degree angles with reference to the longitudinal centerline axis bisecting said first inclined step, and said first straight portion has a diameter more than substantially fifty percent of the total diameter of said arrowhead graduated step punch configuration, wherein the length of said first straight portion is not less than substantially one and one quarter times the diameter of said first straight portion;

(2) said second taper angle of said second inclined step is not less than substantially fifty degrees, which is the included angle formed by both twenty-five degree angles with reference to the longitudinal centerline axis bisecting said second inclined step, and said second straight portion has a diameter more than substantially eighty percent of the total diameter of said arrowhead graduated step punch configuration, and wherein the length of said second straight portion is not less than substantially one and one half times the diameter of said second straight portion; and (3) said third taper angle of said third inclined step is not less than substantially forty degrees, which is the included angle formed by both twenty degree angles with reference to the longitudinal centerline axis bisecting said third inclined step.

28. A hunting arrowhead adapted to be attached to the end of an arrow shaft for maximizing penetration, shock, hemorrhaging and bleed-out comprising:

(a) means for providing a portion of said arrowhead to have relative rearward movement with respect to the arrow shaft it is mounted on during acceleration;

(b) passive resistant means for absorbing and thereby reducing the shock of the inertial forces exerted by the mass of said relative rearward moving arrowhead portion upon the arrow shaft it is mounted on during acceleration;

nc) said arrowhead having a graduated step punch configuration comprising:

(1) a first inclined step on the forward end of said arrowhead having a first taper angle adapted to force matter forward and to the side rather than separate the matter, followed by a straight portion parallel to the center axis of said arrowhead; and (2) a second inclined step beginning at the rearward end of said straight portion having a second taper angle adapted to further force matter forward and to the side rather than to separate the matter;

(d) whereby said graduated step punch configuration creates a less restricted path, with said first inclined step clearing the greatest amount of the matter from the path of said arrowhead and said arrow shaft by directing their kinetic energy to force matter forward and clear it to the side, thereby maximizing penetration, shock, hemorrhaging and bleed-out.

29. A hunting arrowhead adapted to be attached to the end of an arrow shaft, for maximizing penetration, shock, hemorrhaging and bleed-out according to claim 28 wherein:

(1) said first taper angle of said first inclined step is not less than substantially sixty degrees, which is the included angle formed by both thirty degree angles with reference to the longitudinal centerline axis bisecting said first inclined step, and said first straight portion has a diameter more than a first given percent of the total diameter of said arrowhead graduated step punch configuration, and wherein the length of said first straight portion is at least a first given number of times the diameter of said first straight portion; and (2) said second taper angle of said second inclined step is not less than a second given angle.

30. A hunting arrowhead adapted to be attached to the end of an arrow shaft for maximizing penetration, shock, hemorrhaging and bleed-out comprising:

(a) means for providing a portion of said arrowhead to have relative rearward movement with respect to the arrow shaft it is mounted on during acceleration;

(b) passive resistant means for absorbing and thereby reducing the shock of the inertial forces exerted by the mass of said relative rearward moving arrowhead portion upon the arrow shaft it is mounted on during acceleration;

(c) said arrowhead having a graduated step punch configuration comprising:

(1) a first inclined step on the forward end of said arrowhead having a first taper angle adapted to force matter forward and to the side rather than separate the matter, followed by a first straight portion parallel to the center axis of said arrowhead;

(2) a second inclined step beginning at the rearward end of said straight portion having a second taper angle adapted to further force matter forward and to the side rather than to separate the matter, followed by a second straight portion parallel to the center axis of said arrowhead; and (3) a third inclined step beginning at the rearward end of said second straight portion having a third taper angle adapted to still further force matter forward and to the side rather than separate the matter;

(d) whereby said graduated step punch configuration creates a less restricted path, with said first inclined step clearing the greatest amount of the matter from the path of said arrowhead and said arrow shaft by directing their kinetic energy to force matter forward and clear it to the side, thereby maximizing penetration, shock, hemorrhaging and bleed-out.

31. A hunting arrowhead adapted to be attached to the end of an arrow shaft comprising:

(a) a hollow elongated body having a rearward base with a first axial slit through its wall extending from said base to a point near its forward end;

(b) a punching slide pin slidably received in said hollow elongated body and hving a second axial slit aligned with first slit;

(c) at least one blade rotatively mounted on said punching slide pin and adapted to rotate outwardly around a pivot point through said aligned first and second axial slits;

(d) said blade having a forward portion forward of said pivot point and a rearward portion rearward of said pivot point;

(e) a first stage opening cam portion on the rearward end of said blade;

(f) a second stage maximum leveraging cam portion on the forward end of said blade;

(g) resilient passive resistant means engaging said blade rearward of said pivot point for gently urging said blade to an enclosed forward retracted position within said hollow elongated body;

(h) whereby when said arrowhead is accelerated, said hollow elongated body moves forward with respect to said punching slide pin urging said first stage cam portion of said blade against said base of said hollow elongated body thereby rotating said blades against said resilient passive resistant means through said first and second axial slits outwardly from said hollow elongated body, thereby dampening the inertial forces transmitted to the arrow shaft said arrowhead is mounted on during acceleration.

32. A hunting arrowhead according to claim 31 wherein said resilient passive resistant means absorbs the shock of the inertial forces exerted by the mass of said blade and said punching slide pin during said acceleration, and wherein the resilient aspect of said resilient passive resistant means further permits the energy of the inertial forces absorbed during acceleration to be stored for further use.

33. A hunting arrowhead according to claim 32 wherein the energy stored during acceleration in said resilient passive resistant means urges said blade back into said hollow elongated body upon deceleration of said arrowhead.

34. A hunting arrowhead according to claim 33 wherein upon initial impact of said arrowhead with the outer surface of the intended game, said hollow elongated body moves forward with respect to said punching slide pin urging said first stage opening cam portion of said blade against said rearward base of said hollow elongated body thereby rotating said blade against said resilient passive resistant means through said first and second axial slits outwardly from said hollow elongated body to an open forward entry cutting position prior to penetration.

35. A hunting arrowhead according to claim 34 wherein upon continued penetration of said arrowhead, said blade is permitted to rotate to its widest cutting position thereby engaging said second stage maximum leveraging cam portion with the outer edge of said rearward base, whereby continued pressure on said punching slide pin levers said blade toward said widest cutting position.

36. A hunting arrowhead according to claim 35 wherein said arrowhead is configured to hold said blade in an open cutting position, whereby pressure against said blade while cutting will assist in leveraging said blade open to cut a wide path.

37. A hunting arrowhead according to claim 36 further comprising:

(a) a retaining shoulder ridge located on the forward end of said punching slide pin;

(b) exterior threads on the forward end of said hollow elongated body;

(c) an end cap having a hole straight through enabling it to be slidably mounted over the forward end of said punching slide pin, said hole being restricted in size so as to not allow said retaining shoulder ridge on said punching slide pin to pass through, wherein said end cap may be mounted on the forward end of said hollow elongated body by means of threading, thereby restricting the forward movement of said punching slide pin for retention within said hollow elongated body, while also limiting the minimal cutting width of said blade.

38. A hunting arrowhead according to claim 37 wherein said blade may readily retract to a narrow predetermined cutting width for more efficient penetration through bone after said punching slide pin has passed through.

39. A hunting arrowhead according to claim 38 whereby when said arrowhead is withdrawn rearward, said blade may rotate forward to a retracted position having no diametric projection beyond the outer diameter of said arrowhead body, thereby facilitating ease of removal and causing the least damage to the game.

40. A hunting arrowhead according to claim 39 having an arrowhead total weight of not more than 76 grains, matching that which is used for replaceable target point arrowheads, thereby enabling the archer to use the same arrow shaft for hunting as may be used for tournament target competition.

41. A hunting arrowhead adapted to be attached to the end of an arrow shaft comprising:

(a) a hollow elongated body having a rearward base with a first axial slit through its wall extending from said base to a point near its forward end;

(b) a punching slide pin slidably received in said hollow elongated body and having a second axial slit aligned with first slit;

(c) at least one blade rotatively mounted on said punching slide pin and adapted to rotate outwardly around a pivot point through said aligned first and second axial slits;

(d) said blade having a forward portion forward of said pivot point and a rearward portion rearward of said pivot point;

(e) a first stage opening cam portion on the rearward end of said blade;

(f) a second stage maximum leveraging cam portion on the forward end of said blade;

(g) resilient passive resistant means engaging said blade rearward of said pivot point for gently urging said blade to an enclosed forward retracted position within said hollow elongated body;

(h) whereby when said arrowhead is accelerated, said hollow elongated body moves forward with respect to said punching slide pin urging said first stage cam portion of said blade against said base of said hollow elongated body thereby rotating said blades against said resilient passive resistant means through said first and second axial slits outwardly from said hollow elongated body, thereby dampening the inertial forces transmitted to the arrow shaft said arrowhead is mounted on during acceleration;

(i) said arrowhead having a graduated step punch configuration comprising:

(1) a first inclined step on the forward end of said arrowhead having a first taper angle adapted to force matter forward and to the side rather than separate the matter, followed by a straight portion parallel to the center axis of said arrowhead; and (2) a second inclined step beginning at the rearward end of said straight portion having a second taper angle adapted to further force matter forward and to the side rather than to separate the matter;

(j) whereby said graduated step punch configuration creates a less restricted path, with said first inclined step clearing the greatest amount of the matter from the path of said arrowhead and said arrow shaft by directing their kinetic energy to force matter forward and clear it to the side, thereby maximizing penetration, shock, hemorrhaging and bleed-out.

42. A hunting arrowhead adapted to be attached to the end of an arrow shaft comprising:

(a) a hollow elongated body having a rearward base with a first axial slit through its wall extending from said base to a point near its forward end;

(b) a punching slide pin slidably received in said hollow elongated body and having a second axial slit aligned with first slit;

(c) at least one blade rotatively mounted on said punching slide pin and adapted to rotate outwardly around a pivot point through said aligned first and second axial slits;

(d) said blade having a forward portion forward of said pivot point and a rearward portion rearward of said pivot point;

(e) a first stage opening cam portion on the rearward end of said blade;

(f) a second stage maximum leveraging cam portion on the forward end of said blade;

(g) resilient passive resistant means engaging said blade rearward of said pivot point for gently urging said blade to an enclosed forward retracted position within said hollow elongated body;

(h) whereby when said arrowhead is accelerated, said hollow elongated body moves forward with respect to said punching slide pin urging said first stage cam portion of said blade against said base of said hollow elongated body thereby rotating said blades against said resilient passive resistant means through said first and second axial slits outwardly from said hollow elongated body, thereby dampening the inertial forces transmitted to the arrow shaft said arrowhead is mounted on during acceleration;

(i) said arrowhead having a graduated step punch configuration comprising:

(1) a first inclined step on the forward end of said arrowhead having a first taper angle adapted to force matter forward and to the side rather than separate the matter, followed by a first straight portion parallel to the center axis of said arrowhead;

(2) a second inclined step beginning at the rearward end of said second step straight portion having a second taper angle adapted to further force matter forward and to the side rather than to separate the matter, followed by a second straight portion parallel to the center axis of said arrowhead; and (3) a third inclined step beginning at the rearward end of said second straight portion having a third taper angle adapted to still further force matter forward and to the side rather than separate the matter;

(j) whereby said graduated step punch configuration creates a less restricted path, with said first inclined step clearing the greatest amount of the matter from the path of said arrowhead and said arrow shaft by directing their kinetic energy to force matter forward and clear it to the side, thereby maximizing penetration, shock, hemorrhaging and bleed-out.

43. A hunting arrowhead adapted to be attached to the end of an arrow shaft for maximizing penetration, shock, hemorrhaging and bleed-out according to claim 24 wherein:

(1) said straight portion has a diameter more than a first given percent of the total diameter of said arrowhead graduated step punch configuration, wherein the length of said straight portion is at least a first given number of times the diameter of said straight portion; and (2) said second taper angle of said second inclined step is not less than a second given angle.

* * * * *